US010507593B2

(12) United States Patent
Schweigl et al.

(10) Patent No.: US 10,507,593 B2
(45) Date of Patent: Dec. 17, 2019

(54) CUTTING SYSTEM AND METHOD FOR A CUTTING SYSTEM

(71) Applicant: D. SWAROVSKI KG, Wattens (AT)

(72) Inventors: Johannes Schweigl, Mieming (AT); Hubert Schwabegger, Sistrans (AT); Joachim Karger, Vomp (AT); Gerhard Lindenthaler, Pettnau (AT); Andreas Mimm, Innsbruck (AT)

(73) Assignee: D. Swarovski KG, Wattens (AT)

( * ) Notice: Subject to any disclaimer, the term of this patent is extended or adjusted under 35 U.S.C. 154(b) by 0 days.

(21) Appl. No.: 15/561,308

(22) PCT Filed: Mar. 13, 2016

(86) PCT No.: PCT/EP2016/055386
§ 371 (c)(1),
(2) Date: Sep. 25, 2017

(87) PCT Pub. No.: WO2016/156019
PCT Pub. Date: Oct. 6, 2016

(65) Prior Publication Data

US 2018/0104852 A1 Apr. 19, 2018

(30) Foreign Application Priority Data

Mar. 28, 2015 (EP) ..... 15161552

(51) Int. Cl.
*B24B 49/10* (2006.01)
*B28D 5/02* (2006.01)
*B28D 5/00* (2006.01)

(52) U.S. Cl.
CPC ..... *B28D 5/024* (2013.01); *B28D 5/029* (2013.01); *B28D 5/0082* (2013.01)

(58) Field of Classification Search
CPC ..... B24B 49/10
(Continued)

(56) References Cited

U.S. PATENT DOCUMENTS

2002/0104422 A1 8/2002 Negishi
2002/0184982 A1 12/2002 Smith et al.

FOREIGN PATENT DOCUMENTS

CN 1727166 A 2/2006
JP H09207124 A 8/1997
(Continued)

OTHER PUBLICATIONS

Rijks, Mark; European Search Report; European Application No. EP 15161552.3; dated Sep. 10, 2015; European Patent Office; Munich, Germany.
(Continued)

*Primary Examiner* — Robert A Rose
(74) *Attorney, Agent, or Firm* — Stevens & Showalter, L.L.P.

(57) ABSTRACT

The invention relates to a cutting system. The cutting system (1) is designed to extend in the direction of a first system axis (7) which extends horizontally along a width (B) of the cutting system (1), in the direction of a second system axis (8) which extends vertically relative to the first system axis (7), and in the direction of a third system axis (9) which extends along the depth (T) of the cutting system orthogonally to the first system axis (7) and the second system axis (8). The cutting system has a support (2), a tool (3; 4) which is received on the support (2) in the form of a saw with a spindle shaft (13; 14), the operating direction of the tool following the direction of the first system axis (7), and an additional tool (5) which is received on the support (2) in the form of a chop saw with a third spindle shaft (15), the operating direction of the additional tool following the direction of the first system axis (7). The tools (3; 4; 5) are used to machine a blank, and the tools (3; 4; 5) are arranged in series in the direction of the first system axis (7). The cutting system (1) has a support element (10) which is received on the support (2) in a movable manner along the
(Continued)

Figure 1:
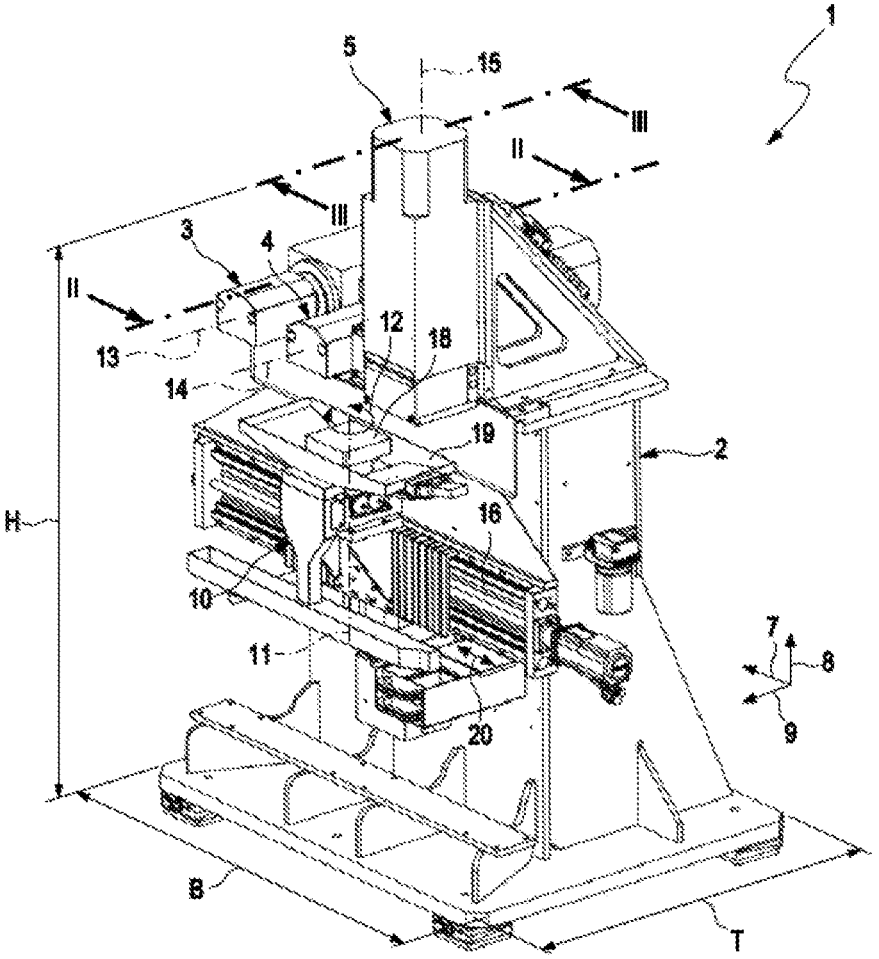

first system axis (7) and the second system axis (8), and the support element (10) is provided for supporting the blank. The support element (10) can be rotated about the second system axis (8), and according to the invention, the spindle shaft (13; 14) is orthogonal to the third spindle shaft (15).

13 Claims, 3 Drawing Sheets

(58) Field of Classification Search
USPC ..... 451/5, 28, 8–10, 41, 65
See application file for complete search history.

(56) References Cited

FOREIGN PATENT DOCUMENTS

| | | | |
|---|---|---|---|
| JP | H11198131 | A | 7/1999 |
| KR | 1020120090437 | A | 8/2012 |
| KR | 101395303 | B1 | 5/2014 |

OTHER PUBLICATIONS

Rijks, Mark; International Search Report and Written Opinion; International Application No. PCT/EP2016/055386; dated Jun. 17, 2016; European Patent Office; Rijswijk, Netherlands.
Indian Official Action; India Application No. 201727037838; dated Jul. 19, 2019; Intellectual Property India; Mumbai, India.

CUTTING SYSTEM AND METHOD FOR A CUTTING SYSTEM

FIELD OF THE INVENTION

The invention relates to a cutting apparatus according to claim 1 and to a method for a cutting apparatus according to claim 9.

PRIOR ART

Cutting apparatuses for producing geometrical workpieces such as cubes, cuboids or prisms are known. Typically, a plurality of workpieces are produced from one blank. The blank is usually cuboid or shapeless. In order to produce the workpieces, the blank is first split or cut into discs. These discs are in turn split or cut into bars. Finally, the bars are divided or trimmed into smaller element portions, i.e. in this step the workpieces are provided with their corresponding length for further machining, for example polishing.

The discs and bars are typically produced using multi-blade saws that comprise a plurality of saw blades on the spindle shaft thereof. The individual bars are also split using the multi-blade saw.

Further operations that arrange and align the discs and bars occur between the machining operations. Thus, for example, said bars are typically manually applied to a retaining device that can also be formed as adhesive tape. In this case, the bars are arranged perpendicularly to a longitudinal direction of the retaining device, in the longitudinal extension thereof.

US 2002/184982 A1 thus discloses a cutting apparatus comprising two tools in the form of a saw, each having a spindle shaft, which tools are arranged in series relative to one another. The cutting apparatus is used for cutting support plates and semiconductors into cubes. Said apparatus is intended for increasing a throughput without increasing a rotational speed of the saws, in particular two transport means being mutually parallel.

JP H09 207124 A discloses an apparatus comprising two tools in the form of a saw, each tool comprising a plurality of saw blades. The tools are likewise arranged in parallel. In order to produce rectangular workpieces, a blank is first machined using the first tool, and rotated by 90° before being machined using the second tool, so that a plurality of rectangular cubes is provided.

The object of the invention is therefore that of providing an improved cutting apparatus for efficient production of workpieces, such as cubes, cuboids or prisms, and to specify a method for a cutting apparatus.

The object is achieved according to the invention by a cutting apparatus having the features of claim 1. The further object is achieved according to the invention by a method having the features of claim 9. The further claims relate to advantageous embodiments comprising expedient and non-trivial developments.

DESCRIPTION OF THE INVENTION

The cutting apparatus according to the invention, which is designed to extend in the direction of a first apparatus axis that extends horizontally along the width of said apparatus, a second apparatus axis that extends vertically with respect to the first apparatus axis, and a third apparatus axis that extends orthogonally to the first apparatus axis and second apparatus axis, along the depth of said apparatus, comprises a support. A tool in the form of a saw comprising a spindle shaft is received on the support, the working direction of which tool is in the direction of the first apparatus axis. A further tool in the form of a chop saw comprising a third spindle shaft, the working direction of which tool is also in the direction of the first apparatus axis, is also received on the support. Both tools are used for machining a blank. The tools are arranged in series in the direction of the first apparatus axis. The cutting apparatus comprises a support element that is received on the support so as to be movable along the first apparatus axis and the second apparatus axis, the support element being provided for retaining the blank, and the support element being rotatable about the second apparatus axis, and the spindle shaft being orthogonal to the third spindle shaft.

In this case, the working direction is to be understood as the relative motion between the blank and the tool that is necessary when machining the blank and/or the semi-finished product.

The cutting apparatus according to the invention makes it possible to reduce the large number of method steps for producing workpieces in the shape of cubes, cuboids or prisms. The fundamental machining steps for producing the workpieces from the blank can be divided into making a grid-like incision in the blank and cutting transversely to the incision, and trimming. The grid-like incision produces a plurality of bars which, since the grid-like incision does not fully penetrate the blank, are interconnected by a core of the blank. The trimming severs the bars transversely to the extension direction thereof, in order to result in the workpieces.

The cutting apparatus according to the invention is advantageous in that the blank, which is positioned on the support element, can be transported from tool to tool using the movable support element. In other words, the blank is fixed to the support element at the start of machining and is fed on the support element, possibly completely automatically, to the tools for machining. Feeding the blank and/or a semi-finished product to the tools is significantly easier in terms of handling than feeding the tools to the blank and/or semi-finished product.

Since the support element can be rotated about the second apparatus axis, it is possible, by rotating the support element after a first incision, to make the grid-like incision using the same tool, which tool is usually designed as a multi-blade saw. Depending on the workpiece cross section required, the support element can be rotated by any desired angle.

It is further advantageous for the blank to be precisely positioned relative to the working directions of the tools, since said blank is received, by means of the support element, on the support that supports the tools. The support element is positioned along a first and second apparatus axis that is fixed relative to the working directions. Thus, positioning errors, such as occur, for example, due to manual removal and insertion of the blank following machining steps, are prevented in the tool that is relevant for the next machining step. This means that the further method steps required between the machining steps, such as manually sorting and fixing bars and/or discs, are omitted.

Moreover, a plurality of blanks can also be arranged on the support element, resulting in efficient use of the tools.

In one embodiment of the cutting apparatus according to the invention, in order to move the support element in the direction of the first apparatus axis, a first linear shaft is formed on the support so as to extend in the direction of the first apparatus axis, and, in order to move the support element in the direction of the second apparatus axis, a second linear shaft is formed on the support so as to extend in the direction of the second apparatus axis. The advantage of the linear shafts formed on the support is that a movement of the support element in the direction of the linear shafts is accurate, i.e. is without deviation of direction. Thus, precise cuts are formed in the blank in the case of movement along the second linear shaft, for example.

In another embodiment, an additional tool in the form of a saw comprising an additional spindle shaft is received on the support. A further machining step can thus be carried out using the additional tool. The blank comprising the bars is first arranged accordingly, by means of the first linear shaft, for machining using the further tool. Said blank is then moved on the support, along the first linear shaft, for further machining using the additional tool.

In another embodiment of the cutting apparatus according to the invention, the additional tool has a working direction that is in the direction of the first apparatus axis. Since the additional tool is designed in the form of a multi-blade saw, the additional tool can be arranged in series on the support so as to be immediately upstream or downstream of the tool. The advantage is that the first incision and/or a first group of cuts is made by the tool, and subsequently the support element together with the blank comprising the first group of cuts is rotated about the second apparatus axis and positioned on the additional tool for machining. Using the additional tool, a second incision and/or a second group of cuts that is transverse to the first group of cuts is made in the blank.

A significant advantage of the additional tool is that a first spacing between the individual saw blades of the multi-blade saw of the tool differs from a second spacing between the individual saw blades of the multi-blade saw of the additional tool, and thus workpieces that differ from a cube can be created in a simple manner, without the need to exchange the workpiece on the support.

In another embodiment, the support element is designed such that it comprises a support plate for fixedly receiving the blank. The advantage is improved handling, since the support plate can be loaded independently of support elements, outside the cutting apparatus.

In another embodiment, a container is designed to receive the support plate, a permeable sieve being fixed to the support downstream of the container, the passage openings of which sieve are smaller than workpieces produced from the blank. Thus, the workpieces created can advantageously be removed from the tool, in particular the chop saw, and carried away from the tool by means of a coolant and lubricant, said workpieces collecting in the container. The coolant and lubricant can nevertheless be removed by the sieve in order to prevent the container from overflowing.

It is advantageous to arrange a second container that is positioned so as to be in series with the first container in the outflow direction, since, as a result, when the first container is completely filled, said container can be removed from the cutting apparatus and the workpieces can fall into the second container.

The container can preferably be coupled to the support. If, for example, the container is suspended on the support, the workpieces that have collected in the container can thus be removed from the cutting apparatus by simply removing the container.

In another embodiment, the chop saw comprises at least two saw blades. The advantage is that the number of method steps for producing workpieces such as prisms or cubes is halved, and thus reduced, on account of the two saw tooth discs that are mutually parallel.

The second aspect of the invention relates to a method for a cutting apparatus, the cutting apparatus being designed according to any of claims 1 to 9, and being designed to extend in the direction of a first apparatus axis that extends horizontally along the width of said apparatus, a second apparatus axis that extends vertically with respect to the first apparatus axis, and a third apparatus axis that extends orthogonally to the first apparatus axis and second apparatus axis, along the depth of said apparatus, and comprises a support. A tool in the form of a saw comprising a spindle shaft is received on the support, the working direction of which tool is in the direction of the first apparatus axis. A further tool in the form of a chop saw comprising a third spindle shaft, the working direction of which tool is also in the direction of the first apparatus axis, is also received on the support. Both tools are used for machining a blank. The tools are arranged in series in the direction of the first apparatus axis. The cutting apparatus comprises a support element that is received on the support so as to be movable along the first apparatus axis and the second apparatus axis, the blank being fixed to the support element, and the support element being rotatable about the second apparatus axis, and the spindle shaft being orthogonal to the third spindle shaft.

The blank is machined in that (a) in a first positioning step, the blank is positioned for machining using the tool (3),
(b) in a first machining step, the blank is provided with a first group of cuts,
(c) in a second positioning step, following the first machining step, the blank is rotated in the cutting apparatus by a specified angle about the second apparatus axis,
(d) in a second machining step, the blank is provided with a second group of cuts that is transverse to the first group of cuts,
(e) in a third positioning step, following the second machining step, the blank is moved along the first linear shaft for machining, and
(f) in a third machining step, the blank is trimmed.

The method according to the invention thus has three machining steps that result in the production of a plurality of workpieces from one blank. The machining steps are reduced compared with a method of the prior art. There are two positioning steps between the machining steps, which machining steps are characterised in that the tools machine the blank. Since, on account of the support element, the positioning on the support occurs along the first apparatus axis and the second apparatus axis, exact positioning relative to the tools is possible by means of just two positioning steps.

In one embodiment of the method, the first group of cuts and the second group of cuts are filled with a substitute material after the first and/or second machining step and before the third machining step. By filling, and thus filling in, the groups of cuts using a substitute material, breakages of the workpiece that may occur during trimming can be reduced. Thus, possible scrap can be prevented and/or reduced, and therefore production costs can be kept low.

In another embodiment of the method, the first positioning step additionally comprises moving the support element along the first linear shaft, provided that the cutting apparatus contains an additional tool in the form of a saw comprising an additional spindle shaft, the working direction of which tool is in the direction of the first apparatus axis.

Positioning of the blank for the second and/or third operation is preferably carried out along the first linear shaft.

The advantage is that a tool change is not required, and production times are thus significantly reduced.

The blank preferably consists of cubic zirconia. The advantage of cubic zirconia is the properties thereof that are approximate to a diamond. In particular, on account of the refractive index thereof, said cubic zirconia is preferably used for gems, which can be produced rapidly and in large numbers using the method.

Figure 2:
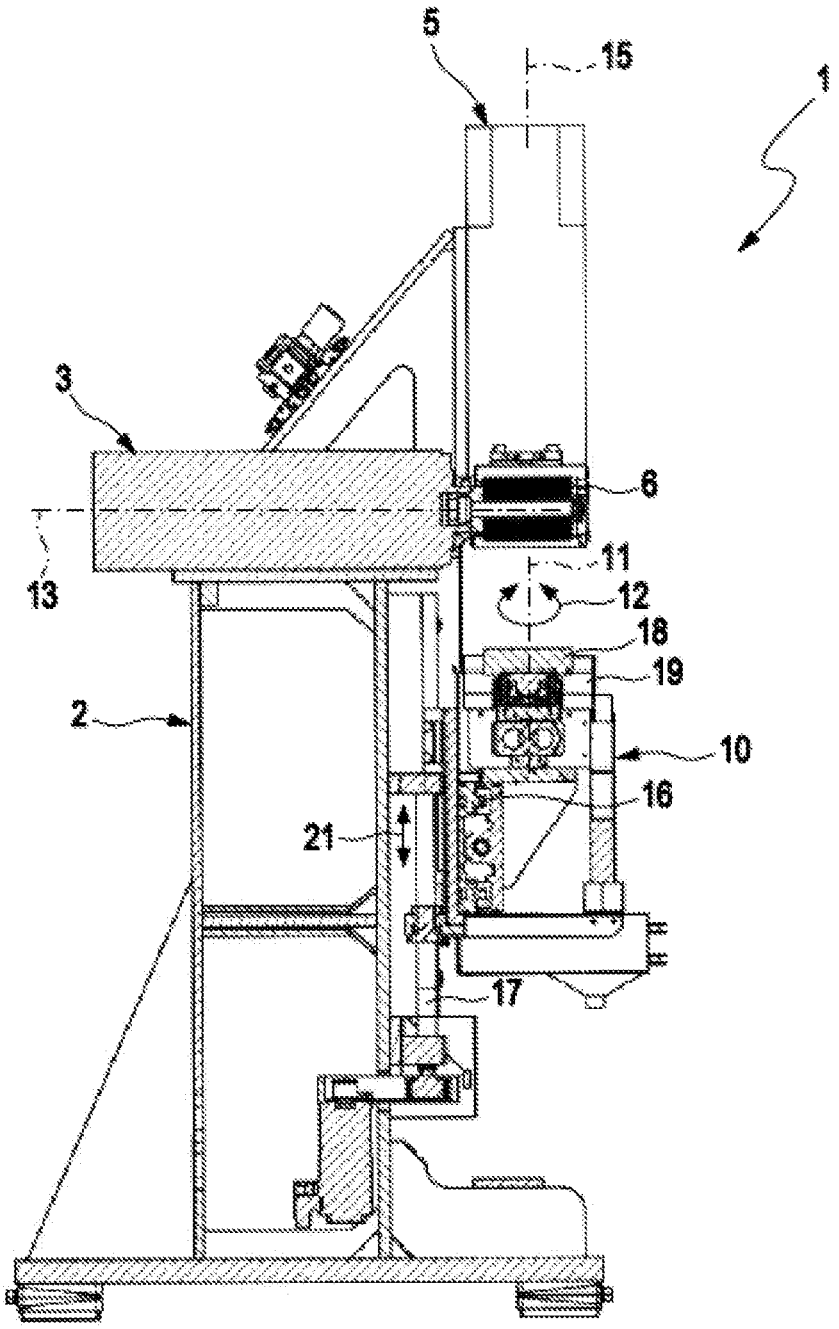
Figure 3:
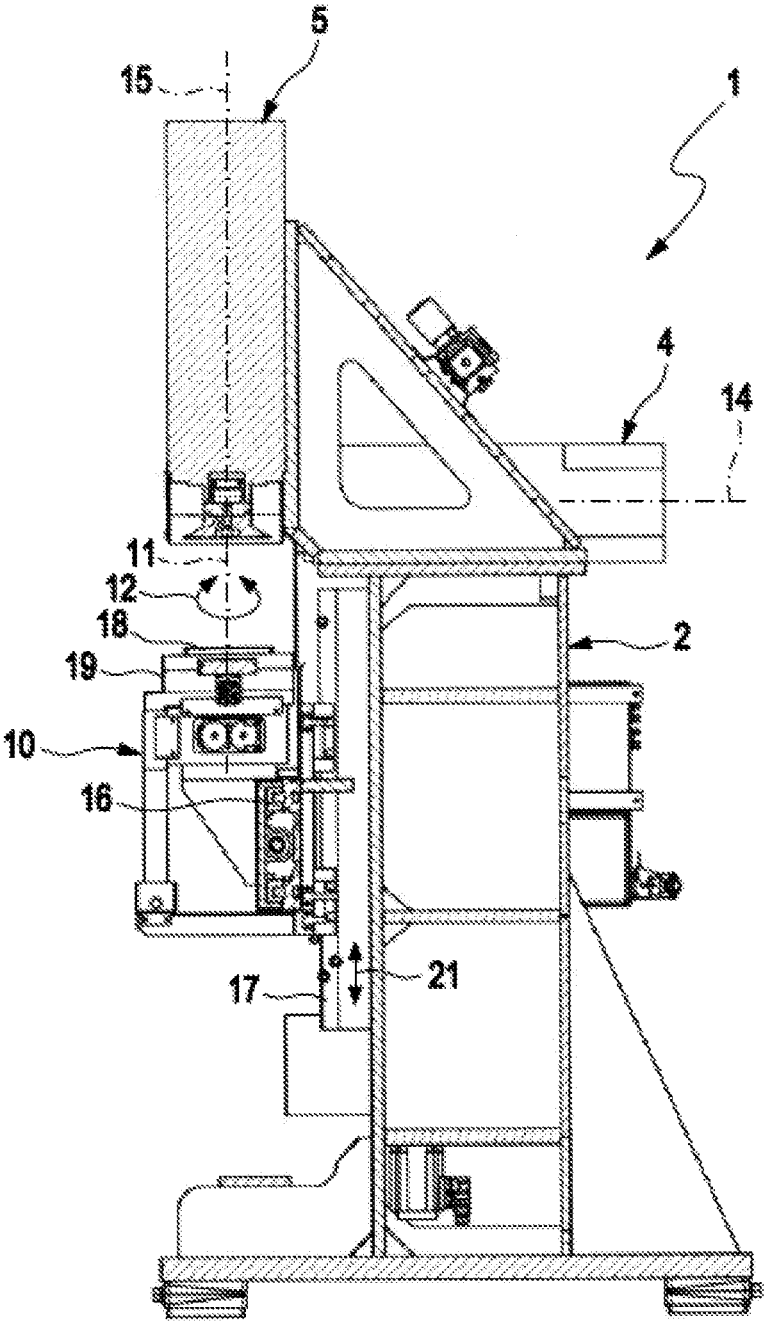

Further advantages, features and details of the invention can be found in the following description of preferred embodiments and with reference to the drawings. However, the features and combinations of features mentioned above in the description and mentioned below in the description of the figures, and/or features and combinations of features shown only in the figures, can be implemented not only in the combination specified in each case, but rather also in any other combinations or individually, without departing from the scope of the invention. The same or functionally similar elements are provided with identical reference signs. For reasons of clarity, it is possible that the elements may not be provided with their reference signs in all the figures, but the association remains. In the figures:

FIG. 1 is a perspective view of a cutting apparatus according to the invention, FIG. 2 is a first longitudinal section of the cutting apparatus according to FIG. 1, and FIG. 3 is a second longitudinal section of the cutting apparatus according to FIG. 1.

FIG. 1 shows a cutting apparatus 1 according to the invention. The cutting apparatus 1 comprises a support 2 for receiving a tool 3 that is referred to in the following as the first tool 3 and comprises a first spindle shaft 13, and an additional tool 4 that is referred to in the following as the second tool 4 and comprises a second spindle shaft 14, and a further tool 5 that is referred to in the following as the third tool 5 and comprises a third spindle shaft 15. In this embodiment, the first tool 3 and the second tool 4 are formed as a multi-blade saw. In other words, the first tool 3 and the second tool 4 comprise a plurality of parallel, equally sized saw blades 6 (see FIG. 2). The third tool 5 is formed as a chop saw. The tools 3, 4 and 5 are driven by their spindle shafts 13, 14 and 15. The third spindle shaft 15 and the first spindle shaft 13 and/or the second spindle shaft 14 are orthogonal, the first spindle shaft 13 and the second spindle shaft 14 being mutually parallel.

The cutting apparatus 1 comprises a first apparatus axis 7, in the direction of which the width B of the cutting apparatus 1 extends. Moreover, the height H and depth T of the cutting apparatus 1 extend in the direction of a second apparatus axis 8 and third apparatus axis 9, respectively. The first apparatus axis 7, the second apparatus axis 8 and the third apparatus axis 9 are positioned so as to be orthogonal to one another. For an improved representation, the apparatus axes 7, 8 and 9 are shown symbolically in the form of a Cartesian coordinate system.

A support element 10 is formed on the support 2, which element is rotatable about a pivot axis that corresponds to the second apparatus axis 8. The support element 10 is designed in the form of a rotary table and can be rotated and/or pivoted about the pivot axis 11 in the direction of the first arrow 12.

In the present embodiment, the three tools 3, 4 and 5 are immovably fixed to the support 2. In order to achieve a positioning and/or infeed motion and feed motion, the support element 10 can be moved in the direction of the first apparatus axis 7 and the second apparatus axis 8, the support 10 comprising a first linear shaft 16 and/or a second linear shaft 17 for this purpose. The feed motion occurs along the first apparatus axis 7, in the direction of the second arrow 20. The infeed motion is carried out in the direction of the second arrow 20 and third arrow 21, along the first apparatus axis 7 and second apparatus axis 8.

Likewise, the tools 3, 4 and 5 could also be received on the support 2 so as to be movable. This would mean that, although, for example, the support element 10 is designed to be able to carry out its pivoting movement, the tools 3, 4 and 5 are assigned the infeed and feed motions in addition to their cutting and trimming functions.

In order to achieve a rapid and simple tool change, the spindle shafts 13, 14 and 15 of the three tools 3, 4 and 5 are cantilever-mounted on the cutting apparatus 1. The cutting apparatus 1 is designed such that rotational speeds of the tools 3, 4 and 5 of far above 15,000 rpm can be achieved.

The method according to the invention is characterised in that, in a first method step, a blank is immovably fixed to a support plate 18. The support plate 18 is fastened to the support element 10, such that a relative motion is possible between the support plate 18 and the support element 10.

In a first positioning step, the support element 10 is positioned relative to the first tool 3, by means of the first linear shaft 16 and second linear shaft 17 that are designed to carry out the positioning and/or infeed motion, until an intended penetration depth of the saw blades 6 into the blank is achieved. Said penetration depth corresponds to the required depth of cut. The first tool 3 is activated, the saw blades 6 being put into operation. In the first machining step, the support element 10 together with the blank is moved along the first linear shaft 16, which is designed for the feed motion, and into and through the first tool 3. At the end of the first machining step, the blank comprises a first group of cuts in the form of a plurality of parallel incisions.

The cuts and/or incisions do not fully penetrate the blank. The blank thus comprises discs produced by the cuts and/or incisions, which discs are interconnected by a core of the blank. In other words, since the incisions do not fully penetrate the blank, a core is formed that comprises the discs. Since, however, the core of the blank is immovably received on the support plate 18, the discs formed on the core of the blank are likewise immovably fixed to the support plate 18. Further fixing for the next machining step is therefore not necessary.

In a next method step, i.e. the second positioning step, the support plate 18 is rotated about the pivot axis 11 by a specified angle a, which is required for the further cut. If, for example, the finished workpiece is intended to be rectangular or cuboid, the support plate 18 should be rotated about the pivot axis 11 by the angle a having a value of 90°.

Subsequently, the support element 10 together with the blank comprising a first group of cuts is moved relative to the first tool 3, along the first linear shaft 16 and second linear shaft 17, until an intended penetration depth of the saw blades 6 into the blank is achieved. The second tool 4 is activated, the saw blades 6 thereof being put into operation. In the second machining step, the support element 10 together with the blank is moved along the first linear shaft 16, which is designed for the feed motion, and into and through the second tool 4.

The blank now comprises a second group of cuts. The first group of cuts and the second group of cuts together form a cross-cut. In other words, the blank is now cut in a grid-like manner and/or comprises grid-like incisions. Since the second group of cuts is formed in the blank in the same axial direction as the first group of cuts, bar-shaped workpiece elements are provided that are interconnected by the core of the blank.

In order to separate the bar-shaped workpiece elements from the core of the blank, in a next method step, i.e. the third positioning step, the support element 10, together with the blank that now comprises a group of bars, is positioned by means of the first linear shaft 16 and the second linear shaft 17 for machining using the third tool 5, i.e. the chop saw. A corresponding feed is set by the first linear shaft 16, and the bars are cut and/or trimmed to a specified length in the third machining step.

The produced workpieces, which are formed in the shape of cubes, prisms or cuboids, are removed by means of a coolant that is used for cooling and lubrication during operation of the tools 3, 4 and 5. The workpieces are collected in a trough-like container 19 that comprises a sieve for removing the coolant, and are removed from the cutting apparatus 1 together with said container.

In a variant of the method according to the invention, the blank is filled with a substitute material prior to trimming. That is to say that the grid-like incisions are filled in by a substitute material. As a result, breakages during trimming can be prevented.

Likewise, the blank can also already be filled with the substitute material before the second group of cuts is made.

In a further embodiment that is not shown in greater detail, the third tool 5 is formed as a double-bladed chop saw. Thus, two cutting and/or trimming planes can be achieved by one feed position. The duration of the production of the workpieces is thus reduced.

LIST OF REFERENCE SIGNS

1 Cutting apparatus
2 Support
3 First tool
4 Second tool
5 Third tool
6 Saw blade
7 First apparatus axis
8 Second apparatus axis
9 Third apparatus axis
10 Support element
11 Pivot axis
12 First arrow
13 First spindle shaft
14 Second spindle shaft
15 Third spindle shaft
16 First linear shaft
17 Second linear shaft
18 Support plate
19 Container
20 Second arrow
21 Third arrow

The invention claimed is:

1. Cutting apparatus, the cutting apparatus being designed to extend in the direction of a first apparatus axis that extends horizontally along a width (B) of the cutting apparatus, a second apparatus axis that extends vertically with respect to the first apparatus axis, and a third apparatus axis that extends orthogonally to the first apparatus axis and second apparatus axis, along a depth (T) of the cutting apparatus, comprising a support, a tool that is received on the support and is in the form of a saw comprising a spindle shaft, the working direction of which tool is in the direction of the first apparatus axis, and a further tool that is received on the support and is in the form of a chop saw comprising a third spindle shaft, the working direction of which tool is in the direction of the first apparatus axis, the spindle shaft being orthogonal to the third spindle shaft, the tools being used for machining a blank, and the tools being arranged in series in the direction of the first apparatus axis, and the cutting apparatus comprising a support element that is received on the support so as to be movable along the first apparatus axis and the second apparatus axis, the support element being provided for retaining the blank, the support element being rotatable about the second apparatus axis, and the support element comprising a support plate for fixedly receiving the blank, wherein the apparatus comprises a container designed to receive the support plate, and a permeable sieve fixed to the support downstream of the container, the passage openings of which sieve are smaller than workpieces produced from the blank.

2. Cutting apparatus according to claim 1, characterised in that, in order to move the support element in the direction of the first apparatus axis, a first linear shaft is formed on the support so as to extend in the direction of the first apparatus axis, and, in order to move the support element in the direction of the second apparatus axis, a second linear shaft is formed on the support so as to extend in the direction of the second apparatus axis.

3. Cutting apparatus according to claim 1, characterised in that an additional tool is received on the support.

4. Cutting apparatus according to claim 3, characterised in that the additional tool, in the form of a saw comprising an additional spindle shaft, has a working direction that is in the direction of the first apparatus axis.

5. Cutting apparatus according to claim 1, characterised in that the container can be coupled to the support.

6. Method for machining a blank using a cutting apparatus, wherein the cutting apparatus is designed to extend in the direction of a first apparatus axis that extends horizontally along a width (B) of the cutting apparatus, a second apparatus axis that extends vertically with respect to the first apparatus axis, and a third apparatus axis that extends orthogonally to the first apparatus axis and second apparatus axis, along a depth (T) of the cutting apparatus, comprising a support, a tool that is received on the support and is in the form of a saw comprising a spindle shaft, the working direction of which tool is in the direction of the first apparatus axis, and a further tool that is received on the support and is in the form of a chop saw comprising a third spindle shaft, the working direction of which tool is in the direction of the first apparatus axis, the spindle shaft being orthogonal to the third spindle shaft, wherein the tools are used for machining a blank, wherein the tools are arranged in series in the direction of the first apparatus axis, wherein the cutting apparatus comprises a support element that is received on the support so as to be movable along the first apparatus axis and the second apparatus axis, wherein the blank is fixed to the support element, wherein the support element is rotatable about the second apparatus axis, wherein the support element comprises a support plate for fixedly receiving the blank, and wherein the apparatus comprises a container designed to receive the support plate, and a permeable sieve fixed to the support downstream of the container, the passage openings of which sieve are smaller than workpieces produced from the blank, and the method comprising:

(a) in a first positioning step, the blank is positioned for machining using the tool, (b) in a first machining step, the blank is provided with a first group of cuts, (c) in a second positioning step, following the first machining step, the blank is rotated in the cutting apparatus by an angle (a) about the second apparatus axis, (d) in a second machining step, the blank is provided with a second group of cuts that is transverse to the first group of cuts, (e) in a third positioning step, following the second machining step, the blank is moved along the first linear shaft for machining, and (f) in a third machining step, the blank is trimmed.

7. Method according to claim 6, characterised in that the first group of cuts and the second group of cuts are filled with a substitute material after the first and/or second machining step and before the third machining step.

8. Method according to claim 6, characterised in that the second positioning step additionally comprises moving the support element along the first linear shaft, provided that the cutting apparatus contains an additional tool in the form of a saw comprising an additional spindle shaft, the working direction of which tool is in the direction of the first apparatus axis.

9. Method according to claim 6, characterised in that positioning of the blank for the second and/or third operation is carried out along the first linear shaft.

10. Method according to claim 6, characterised in that the blank is cubic zirconia.

11. Method according to claim 6, characterised in that in order to move the support element in the direction of the first apparatus axis, a first linear shaft is formed on the support so as to extend in the direction of the first apparatus axis, and, in order to move the support element in the direction of the second apparatus axis, a second linear shaft is formed on the support so as to extend in the direction of the second apparatus axis.

12. Cutting apparatus, the cutting apparatus being designed to extend in the direction of a first apparatus axis that extends horizontally along a width (B) of the cutting apparatus, a second apparatus axis that extends vertically with respect to the first apparatus axis, and a third apparatus axis that extends orthogonally to the first apparatus axis and second apparatus axis, along a depth (T) of the cutting apparatus, comprising a support, a tool that is received on the support and is in the form of a saw comprising a spindle shaft, the working direction of which tool is in the direction of the first apparatus axis, and a further tool that is received on the support and is in the form of a chop saw comprising a third spindle shaft and at least two saw blades, the working direction of which tool is in the direction of the first apparatus axis, the spindle shaft being orthogonal to the third spindle shaft, the tools being used for machining a blank, and the tools being arranged in series in the direction of the first apparatus axis, and the cutting apparatus comprising a support element that is received on the support so as to be movable along the first apparatus axis and the second apparatus axis, the support element being provided for retaining the blank, and the support element being rotatable about the second apparatus axis.

13. Method for machining a blank using a cutting apparatus, wherein the cutting apparatus is designed to extend in the direction of a first apparatus axis that extends horizontally along a width (B) of the cutting apparatus, a second apparatus axis that extends vertically with respect to the first apparatus axis, and a third apparatus axis that extends orthogonally to the first apparatus axis and second apparatus axis, along a depth (T) of the cutting apparatus, comprising a support, a tool that is received on the support and is in the form of a saw comprising a spindle shaft, the working direction of which tool is in the direction of the first apparatus axis, and a further tool that is received on the support and is in the form of a chop saw comprising a third spindle shaft and at least two saw blades, the working direction of which tool is in the direction of the first apparatus axis, the spindle shaft being orthogonal to the third spindle shaft, wherein the tools are used for machining a blank, wherein the tools are arranged in series in the direction of the first apparatus axis, wherein the cutting apparatus comprises a support element that is received on the support so as to be movable along the first apparatus axis and the second apparatus axis, wherein the blank is fixed to the support element, and wherein the support element is rotatable about the second apparatus axis, and the method comprising:

(a) in a first positioning step, the blank is positioned for machining using the tool, (b) in a first machining step, the blank is provided with a first group of cuts, (c) in a second positioning step, following the first machining step, the blank is rotated in the cutting apparatus by an angle (a) about the second apparatus axis, (d) in a second machining step, the blank is provided with a second group of cuts that is transverse to the first group of cuts, (e) in a third positioning step, following the second machining step, the blank is moved along the first linear shaft for machining, and (f) in a third machining step, the blank is trimmed.

* * * * *